US008151392B2

(12) United States Patent
Littmann et al.

(10) Patent No.: US 8,151,392 B2
(45) Date of Patent: Apr. 10, 2012

(54) METHOD FOR SMOOTHING ARTICLES OF CLOTHING, AND TUNNEL FINISHER

(75) Inventors: Dirk Littmann, Bad Salzuflen (DE); Engelbert Heinz, Vlotho (DE); Jürgen Wolf, Herford (DE)

(73) Assignee: Herbert Kannegiesser GmbH, Vlotho (DE)

( * ) Notice: Subject to any disclaimer, the term of this patent is extended or adjusted under 35 U.S.C. 154(b) by 717 days.

(21) Appl. No.: 11/837,135

(22) Filed: Aug. 10, 2007

(65) Prior Publication Data

US 2008/0034807 A1 Feb. 14, 2008

(30) Foreign Application Priority Data

Aug. 14, 2006 (DE) ..... 10 2006 038 094

(51) Int. Cl.
*D06B 1/02* (2006.01)
*D06F 58/12* (2006.01)

(52) U.S. Cl. ..... 8/149.3; 138/144

(58) Field of Classification Search ..... 8/149.2, 8/149.3; 68/5 R, 5 C, 5 D, 20; 34/210, 218, 34/227, 228, 232, 233; 38/144
See application file for complete search history.

(56) References Cited

U.S. PATENT DOCUMENTS

| | | | | |
|---|---|---|---|---|
| 4,070,876 | A * | 1/1978 | Thompson et al. | 68/3 R |
| 4,304,053 | A * | 12/1981 | Kellerhals et al. | 34/621 |
| 4,761,305 | A * | 8/1988 | Ochiai | 427/180 |
| 5,516,012 | A * | 5/1996 | Weigel | 223/51 |
| 6,311,526 | B1 * | 11/2001 | Frushtick | 68/5 C |
| 2003/0066138 | A1 * | 4/2003 | France et al. | 8/147 |
| 2005/0086826 | A1 * | 4/2005 | Frushtick | 34/218 |
| 2006/0272178 | A1 * | 12/2006 | Frushtick | 34/621 |
| 2007/0101623 | A1 * | 5/2007 | Frushtick | 38/1 R |
| 2007/0261449 | A1 * | 11/2007 | McMillan | 68/5 C |

* cited by examiner

*Primary Examiner* — Joseph L Perrin
(74) *Attorney, Agent, or Firm* — Laurence P. Colton; Smith Risley Tempel Santos LLC

(57) ABSTRACT

A method for additionally conducting the hot air for finishing the articles of clothing (14) along the articles of clothing (14) in counterflow to the transporting direction (13). This leads to more effective finishing of the articles of clothing (14) with greater energy efficiency, and therefore the tunnel finisher according to the invention consumes less energy.

29 Claims, 5 Drawing Sheets

METHOD FOR SMOOTHING ARTICLES OF CLOTHING, AND TUNNEL FINISHER

STATEMENT OF RELATED APPLICATION

This application is based on and claims convention priority on German Patent Application No. 10 2006 038 094.0 having a filing date of 14 Aug. 2006, which is incorporated herein by this reference.

BACKGROUND OF THE INVENTION

1. Technical Field

The invention relates to a method for smoothing laundry items and a method for smoothing articles of clothing (14) in a tunnel finisher, the articles of clothing (14) being transported in the transporting direction (13) through an admission chamber (11), a treatment chamber (10) and a discharge chamber (12) of the tunnel finisher. Furthermore, the invention relates to a tunnel finisher for smoothing articles of clothing, with an admission chamber (11) having an admission opening (15), a treatment chamber (10) and a discharge chamber (12) having a discharge opening (16).

2. Related Art

Tunnel finishers serve to smooth articles of clothing using hot steam and/or hot air. The articles of clothing are transported continuously through the tunnel finisher, preferably hanging on transporting hangers.

Scarcely any measures have been taken in the tunnel finishers known hitherto in order to reduce the energy requirement. Due to constantly increasing energy costs, there is now an endeavor to keep the energy requirement of tunnel finishers as low as possible.

In the case of conventional tunnel finishers, warm or hot air, in particular spray steam, exits at the admission and discharge openings of the admission and discharge chambers, the chambers becoming useless as a result.

Finally, during the smoothing of articles of clothing, with tunnel finishers, problems have arisen with residual moisture in points which are difficult to access or in multi-layered parts, for example hems, of articles of clothing. Said points or parts are not dry when the articles of clothing leave the tunnel finisher. In order to eliminate this problem, high temperatures have been used in particular in the after treatment zone at the end of the tunnel finisher. This leads to an adverse effect on the articles of clothing. In the case of sensitive materials, this may result in overheating, discoloration or even in burning of the fabric.

BRIEF SUMMARY OF THE INVENTION

The invention is based on the object of providing a method for smoothing items of laundry, and a tunnel finisher, which operate gently and with a low energy requirement.

A method for achieving this object has a method for smoothing articles of clothing in a tunnel finisher, comprising the steps of: (a) transporting the articles of clothing in a transporting direction through an admission chamber, a treatment chamber and a discharge chamber of the tunnel finisher; (b) in the treatment chamber, directing a transverse air flow transversely with respect to the transporting direction of the articles of clothing through the treatment chamber; and (c) in addition to the transverse air flow, subjecting the articles of clothing to a counter air flow directed counter to the transporting direction. Owing to the fact that the articles of clothing are additionally acted upon by an air flow directed counter to the transporting direction of the same through the treatment chamber, i.e. a counter air flow, a more effective and, above all, more rapid drying of the articles of clothing takes place. Above all, therefore, more rapid drying of the articles of clothing takes place because it has been shown that higher drying speeds can be obtained with the counter air flow. Since the counter air flow is directed counter to the transporting direction of the articles of clothing in the tunnel finisher, moist air is transported to the start of the treatment chamber. In addition, an at least small positive pressure is produced in the admission chamber by the counter air flow, as a result of which a smaller amount of cold outside air can enter the admission chamber through the admission opening.

The tunnel finisher, in particular its treatment chamber, is preferably formed from a plurality of consecutive modules. The production of the counter air flow takes place by introducing at least some of the air produced in at least one module, in particular warm air, into the previous module in the transporting direction. This takes place in that, when some of the warm air is introduced into the previous module, a positive pressure is produced in the same and increases from module to module counter to the transporting direction. This results in the production in the treatment chamber of a spiral flow which extends through the treatment chamber counter to the transporting direction and brings about, in particular produces, the counter air flow in the treatment chamber. By the quantity of air which is conducted from the module in which it is produced into the previous module being changed, the differences in pressure in the consecutive modules can be changed and, accordingly, the flow velocity of the counter air flow increased or reduced.

A further method for achieving the object mentioned at the beginning has A method for smoothing articles of clothing in a tunnel finisher, comprising transporting the articles of clothing in a transporting direction through an admission chamber, a treatment chamber and a discharge chamber of the tunnel finisher, wherein, by means of an extension of the admission chamber and/or of the discharge chamber, the residence time of the articles of clothing in the admission chamber and/or the discharge chamber is increased over the residence time of the articles of clothing in the admission chamber and/or of the discharge chamber without the extension. This may also be a preferred development of the previously described method. By means of an extension of the admission and/or discharge chamber of the tunnel finisher, the residence time of the articles of clothing in the admission and/or discharge chamber is increased. By means of the extended admission chamber, it is possible therein to preheat the articles of clothing to be finished to an extent such that they in particular reach the cooling limit temperature of approximately 90° C. As a result, in the following treatment chamber, to be precise right at the start of the same, the finishing of the articles of clothing can take place. The extended admission chamber enables the treatment chamber to be used more effectively. By means of the extension of the discharge chamber, the articles of clothing obtain more drying time, and, in particular, the "reevaporation zone" is extended. As a result, even critical points of the articles of clothing, for example seams or doubled widths of material, can be completely dried in the tunnel finisher without the drying temperature having to be raised for this purpose to the extent that there is concern that the articles of clothing will be damaged. In addition, the temperature of the articles of clothing is reduced at the discharge from the tunnel finisher, and they therefore only have to be cooled for a relatively short time.

The admission and/or discharge chamber is/are preferably extended in such a manner that the length of the admission chamber and/or discharge chamber corresponds approximately to the length of a module of the treatment chamber. The admission chamber and/or the discharge chamber at least extend at least over the entire width of the tunnel finisher and preferably also beyond it.

A further method for achieving the object mentioned at the beginning, with it also being possible for this to be a preferred development of the methods mentioned previously, a method for smoothing articles of clothing in a tunnel finisher, comprising transporting the articles of clothing in a transporting direction through an admission chamber, a treatment chamber and a discharge chamber of the tunnel finisher, wherein the articles of clothing are transported in a transversely directed manner through the admission opening and/or the discharge opening, the admission opening and/or the discharge opening being narrower at least in some regions than the articles of clothing. According thereto, it is provided to design the admission and/or discharge opening of the tunnel finisher, through which the articles of clothing are transported in a transversely directed manner, to be narrower at least in some regions than the articles of clothing. The articles of clothing are thereby constricted in the region of the admission and/or discharge opening and, as a result, at least partially block the opening concerned, as a result of which a smaller amount of hot air can exit from the interior of the tunnel finisher at the admission opening and/or a smaller amount of cold ambient air can enter the tunnel finisher through the discharge opening.

Furthermore, it is provided to produce at least one air curtain or one air barrier at the admission and/or discharge opening of the admission and/or discharge chamber of the tunnel finisher. This at least reduces the exiting of warm air or steam from the tunnel finisher and/or the entry of cold outside air into the tunnel finisher.

Furthermore, in a preferred refinement of the method, it is provided for air to be removed by suction above all at the entry opening. As a result, the exiting of warm air, in particular spray steam vapor, from the tunnel finisher, above all from the admission opening of the same, is avoided or at least reduced.

According to a preferred refinement of the method, it is provided to blow out the air sucked up at the admission opening, in particular hot air or spray steam, at the discharge opening in order to produce an air curtain or an air barrier at the discharge opening. This effectively avoids cold ambient air from being sucked into the tunnel finisher through the discharge opening. It is also not necessary to produce hot air in order to produce the air barrier or the air curtain because the warm air removed in any case by suction at the admission opening or the spray steam which has been removed by suction is used. Energy for operating the tunnel finisher is thus effectively saved.

Furthermore, the object mentioned at the beginning is achieved by a method for smoothing articles of clothing in a tunnel finisher, comprising transporting the articles of clothing in a transporting direction through an admission chamber, a treatment chamber and a discharge chamber of the tunnel finisher, wherein, at an exit end of the treatment chamber, the articles of clothing are at least partly subjected to unheated air. This method may also be a preferred development of the methods described previously. According thereto, it is provided according to the invention, at the end of the treatment chamber, to subject the articles of clothing to air which has not been heated using external energy. The articles of clothing are then subjected at the end of the treatment chamber to air which has been heated by the residual heat of the articles of clothing. As a result, a temperature which lies below the other temperatures of the treatment chamber arises at the end of the treatment chamber of the tunnel finisher. This saves on energy for heating the air in the tunnel finisher and, in addition, by means of the reduced temperature at the end of the treatment chamber, the greatest possible protection of the articles of clothing is brought about.

In the case of tunnel finishers with a treatment chamber assembled from a plurality of consecutive modules in the transporting direction, external heating of the air preferably does not take place in the last module. In particular, the air in the last module is heated by the residual heat of the articles of clothing and/or the hot air in the preceding module. As a result, although the treatment air in the last module has a lower temperature in comparison to the other modules, this suffices for ending the finishing operation at the end of the treatment chamber.

According to a development of the method, it is provided to raise the temperature of the air in the last module by blowing hot air in at the exit opening of the discharge chamber by at least some of the hot air blown in at the discharge opening of the discharge chamber, preferably hot air which has been sucked up at the admission chamber, at least partially heating the air in the last module.

Another method for solving the object mentioned at the beginning is a method for smoothing articles of clothing in a tunnel finisher, comprising transporting the articles of clothing in a transporting direction through an admission chamber, a treatment chamber and a discharge chamber of the tunnel finisher, wherein, for the treatment of the articles of clothing to last for a longer time, a distance between consecutive articles of clothing is reduced and/or a transporting distance of the articles of clothing is extended. According to this method, which may also be a preferred development of the methods explained previously, it is provided, in order to increase the period for preheating and/or for reevaporation of the articles of clothing in the end region of the tunnel finisher, to reduce the distance between consecutive articles of clothing and/or to extend the transporting distance of the articles of clothing through the admission and/or end region of the tunnel finisher. With the transporting system extending through the entire tunnel finisher, the residence period of the articles of clothing in the starting and/or end region of the tunnel finisher, in particular in the rear part of the treatment chamber and/or discharge chamber and/or admission chamber, can thus be extended with the conveying speed being maintained. The period for preheating and/or reevaporating the articles of clothing is thereby increased, as a result of which even critical points, in particular seams, hems and/or doubled widths of material of the articles of clothing, can be preheated and said critical regions are dried before the articles of clothing leave the tunnel finisher at the discharge opening.

A tunnel finisher for achieving the object has the features of a tunnel finisher for smoothing articles of clothing, comprising (a) an admission chamber having an admission opening, a treatment chamber and a discharge chamber having a discharge opening, wherein, in the treatment chamber, (b) an air flow directed transversely with respect to a transporting direction of the articles of clothing through the treatment chamber, and (c) a means for producing an air flow assigned to the treatment chamber, the means for producing an air flow produces an air flow directed counter to the transporting direction of the articles of clothing through the treatment chamber. According thereto, it is provided according to the invention that the treatment chamber is assigned means for producing an air flow directed counter to the transporting direction of the articles of clothing through the treatment chamber, namely a counter air flow. The counter air flow leads to a particularly intensive treatment of the articles of clothing in the finisher, above all to more effective drying. In addition, moist air is transported to the start of the treatment chamber and from there to the admission chamber where the moist air can optionally be removed by suction. All this contributes to a more economical manner of operating the tunnel finisher.

The counter air flow is preferably produced by it being possible for at least one air supply opening which opens into the treatment chamber to be supplied with additional air from a region of the treatment chamber that is situated behind it. A positive pressure is thus produced in the front region of the treatment chamber, as a result of which the air, in particular hot air, flows counter to the transporting direction of the articles of clothing through the treatment chamber in the direction of the start of the treatment chamber and to the admission chamber of the tunnel finisher.

In a preferred refinement of the invention, the treatment chamber is formed from a plurality of consecutive modules in the transporting direction of the articles of clothing through the tunnel finisher. The number of modules may be as desired. It fits in with the efficiency of the tunnel finisher. The modules are divided by vertical partitions running in the transporting direction into a treatment chamber section and an air guiding chamber situated next to it. By means of ventilators, air can be sucked into the air supply chamber from the bottom region of the particular treatment chamber section. In this case, it is provided according to the invention to suck in some air from the bottom region of the treatment chamber section of a module into the air guiding chamber of the same module and some air into the air supply chamber of the preceding module in the transporting direction. A spiral passage of the air through the treatment chamber of the tunnel finisher is thus produced, to be precise counter to the transporting direction. As a result, a counter air flow which flows through the entire treatment chamber counter to the transporting direction is produced. Since in the last module, as seen in the transporting direction, some of the air is conducted out of the bottom region of the treatment chamber section into the preceding module, there is an air deficit in the last module. This is compensated for by air from the discharge chamber. By contrast, there is an air excess in the first module. The excess air of the first module flows into the admission chamber. The counter air flow which is directed counter to the transporting direction also comes about by sucking up air from the discharge chamber and conducting air away into the admission chamber.

A further tunnel finisher for achieving the object mentioned at the beginning, with it also being possible for this to be a preferred development of the tunnel finisher described previously, has the features of a tunnel finisher for smoothing articles of clothing, comprising an admission chamber having an admission opening, a treatment chamber and a discharge chamber having a discharge opening, wherein the articles of clothing are conveyed through the treatment chamber in a transporting direction, and wherein the admission chamber and/or the discharge chamber are of a length extending at least over the entire width of the tunnel finisher. According thereto, the admission and/or discharge chamber is/are provided with a relatively large length. The admission and/or discharge chamber extend at least over the entire width of the tunnel finisher.

The admission and/or discharge chamber preferably has/have a length which goes beyond the width of the treatment chamber, preferably by at least the width of the admission and/or discharge chamber. By means of the relatively long admission chamber, effective heating of the articles of clothing or else laundry is brought about. It is thus possible for the articles of clothing to already be heated to the cooling limit temperature of approximately 90° C. in the admission chamber. As soon as the articles of clothing reach the treatment chamber, the finishing operation can begin. The effect achieved by a relatively long discharge chamber is that the reevaporation zone is extended. Points of the articles of clothing, such as seams, hems or doubled widths of material, which are difficult to dry can thus be dried for longer. In addition, the temperature of the articles of clothing in the longer discharge chamber is lowered to a relatively great extent, and therefore they only have to be cooled a little, if at all, when they leave the tunnel finisher.

The object mentioned at the beginning is furthermore achieved by a tunnel finisher with the features of a tunnel finisher for smoothing articles of clothing, comprising an admission chamber having an admission opening, a treatment chamber and a discharge chamber having a discharge opening, wherein the articles of clothing are transported through the treatment chamber in a transporting direction, and wherein at least part of the width of the admission opening and/or of the discharge opening is smaller than the average width of the articles of clothing. This may also be a preferred development of the tunnel finisher described previously. According thereto, the width of the admission and/or discharge opening is smaller over at least part of its/their height than the average width of the items of clothing. The items of clothing are usually transported through the tunnel finisher in a manner oriented transversely with respect to the transporting direction. Accordingly, the admission and discharge openings are usually of a width which corresponds to the maximum width of the articles of clothing to be finished, and preferably somewhat larger. By contrast, the admission opening may also be somewhat smaller than the maximum width of the articles of clothing to be finished. As a result, the admission and discharge openings result in relatively low energy losses. In the case of the tunnel finisher according to the invention, the area of the admission and discharge openings is thus kept as small as possible. In addition, the articles of clothing are constricted in the region of the admission and discharge opening and, as a result, they close the openings for the most part, thus reducing the air exchange at the admission and/or discharge opening, which results in lower energy losses in the tunnel finisher.

The width of the admission and discharge openings is preferably only reduced in a lower region of the articles of clothing to be transported through the tunnel finisher, which region hangs down from a transporting hanger. As a result, the rigid transporting hangers together with upper parts of the items of clothing can be transported in a transversely directed manner through the admission and discharge openings without impediment while those soft and flexible regions of the articles of clothing which are located below the transporting hangers are constricted in the narrower admission and discharge openings.

A further tunnel finisher for achieving the object mentioned at the beginning, with it also being possible for it to be a preferred development of the tunnel finishers described previously, has the features of a tunnel finisher for smoothing articles of clothing, comprising (a) an admission chamber having an admission opening, a treatment chamber and a discharge chamber having a discharge opening; and (b) suction openings and/or blowing openings, wherein the articles of clothing are conveyed through the treatment chamber in a transporting direction, and wherein the admission opening and/or the discharge opening is/are assigned the suction openings and/or blowing openings for the at least very substantial reduction in air exiting from the admission chamber and/or in the ambient air entering into the discharge chamber. According thereto, it is provided for the admission opening and/or the discharge opening to be assigned suction or blowing openings. The latter produce an air barrier which leads to the exiting of air, in particular hot air or hot steam, from the admission chamber or entry of ambient air into the discharge chamber to be at least very largely avoided. As a result, only a reduced amount of warm air is lost from the tunnel finisher, and cold ambient air which would have to be heated in the tunnel finisher is not sucked up to a significant extent.

In a preferred refinement of the apparatus, it is provided that the warm air sucked up at the suction openings of the admission openings is used in order to feed the blowing openings at the discharge opening of the discharge chamber. The warm air removed by suction at the admission opening is used in order, at the discharge opening, to form a warm air curtain which, at least for the most part, avoids cold ambient air being sucked in.

A further tunnel finisher for achieving the object mentioned at the beginning, which may also be a development of the tunnel finishers described previously, has the features of a tunnel finisher for smoothing articles of clothing, comprising an admission chamber having an admission opening, a treatment chamber and a discharge chamber having a discharge opening, wherein the articles of clothing are transported through the treatment chamber in a transporting direction along a conveying route, and wherein some regions of the conveying route of the articles of clothing are increased. Said tunnel finisher is distinguished in that the conveying route of the articles of clothing through the treatment zone is increased at least in the end region of the treatment zone. The treatment zone may be an end region of the treatment chamber or else the discharge chamber. Since the articles of clothing hanging on the transporting hanger are usually transported through the tunnel finisher by means of an encircling conveyor, the residence period of the articles of clothing in each section of length of the tunnel finisher is inevitably the same. The residence period of the articles of clothing can be increased by the conveying route, which is extended according to the invention, of the tunnel finisher which is assigned the extended conveying route. It is thereby possible, for example, to increase the period of reevaporation of the articles of clothing in the tunnel finisher although the conveying speed of the conveyor running continuously through the tunnel finisher corresponds, even in the reevaporation and/or drying region, to that of the preceding regions of the tunnel finisher.

The extension of the conveying route in certain regions of the tunnel finisher is preferably brought about by a serpentine-like course of the conveying route in the regions concerned of the tunnel finisher.

BRIEF DESCRIPTION OF THE DRAWINGS

Preferred exemplary embodiments of the invention are explained in more detail below with reference to the drawing, in which.

DETAILED DESCRIPTION OF PREFERRED EMBODIMENTS

Figure 1:
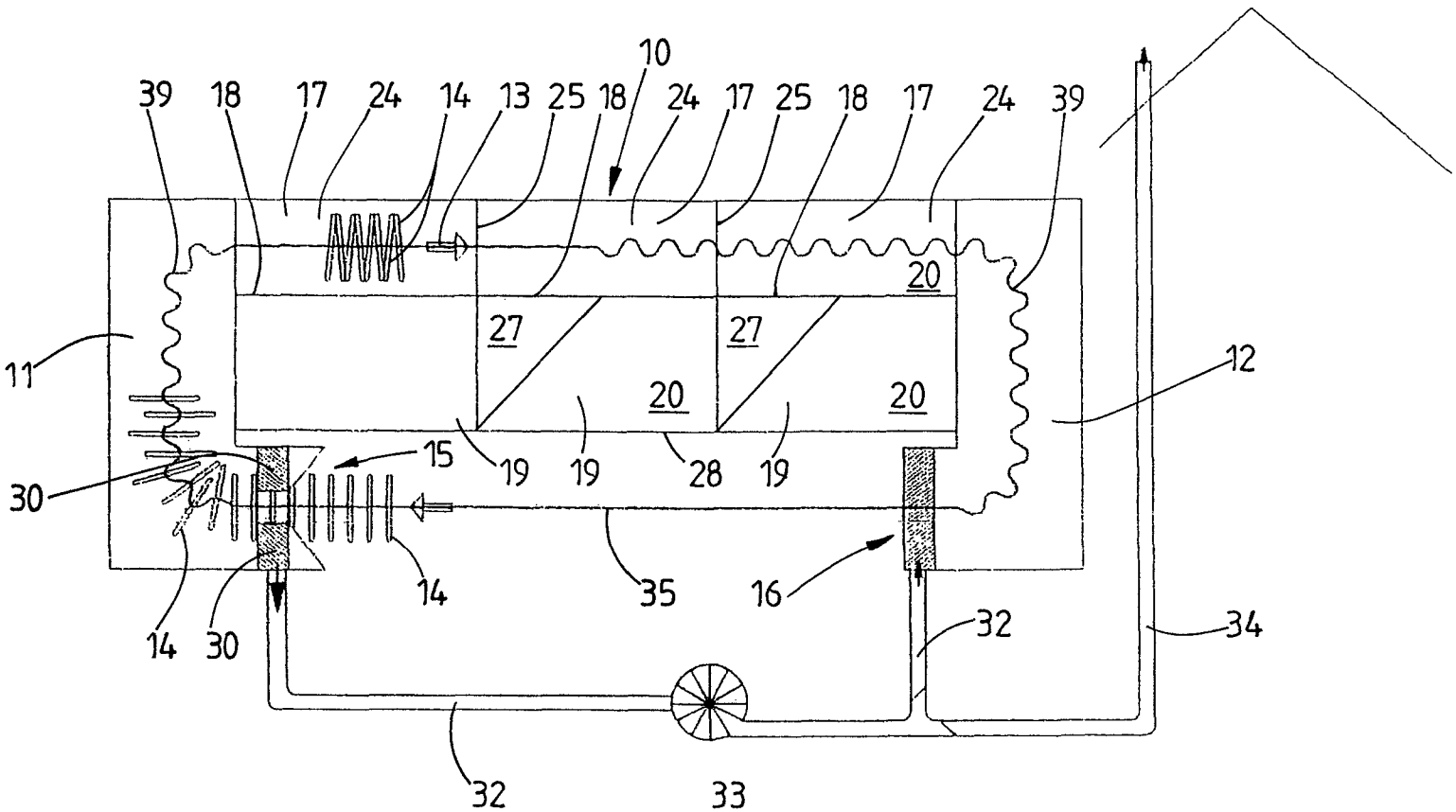
FIG. 1 shows a schematic plan view of a tunnel finisher.

The tunnel finisher shown in the figures has a treatment chamber 10, an admission chamber 11 and a discharge chamber 12. The articles of clothing 14, merely illustrated by indication in FIG. 1 or else other items of laundry are transported in the transporting direction 13, indicated by arrows, through the tunnel finisher in a manner hanging on transporting hangers (not shown). The articles of clothing 14 are transported through the tunnel finisher in a manner oriented transversely with respect to the transporting direction 13. The transporting direction 13 runs perpendicularly with respect to the area or width of the articles of clothing 14. For this purpose, an encircling conveyor, for example a chain conveyor, is arranged in the ceiling region of the tunnel finisher. The transporting chain of the chain conveyor has supporting hooks. A transporting hanger with the item of clothing 14 hanging on it in each case is suspended on each supporting hook.

The articles of clothing 14 hanging on the transporting hangers are transported by the chain conveyor through the admission opening 15 into the admission chamber 11. The articles of clothing 14 pass along the transporting direction 13 out of the admission chamber 11 into the subsequent treatment chamber 10. At the end of the treatment chamber 10, the articles of clothing 14 are transported further in the transporting direction 13 through the discharge chamber 12. The finished articles of clothing 14, hanging on their transporting hanger, leave the tunnel finisher through a discharge opening 16 at the rear end of the discharge chamber 12, seen in the transporting direction 13.

The treatment chamber 10 of the tunnel finisher shown here is formed from three modules 17 arranged one behind another in the transporting direction 13. In the exemplary embodiment shown, all three modules 17 are of approximately identical design, above all are equal in length. Depending on the type of articles of clothing 14 to be treated, the tunnel finisher may have more than or else less than three modules 17. Each module 17 is divided by a vertical partition 18 running longitudinally with respect to the transporting direction 13 into a treatment chamber section 24 forming part of the treatment chamber 10 and into an air guiding chamber 19 situated next to it. The partition 18 is of airtight design. However, the partition 18 ends at a small distance above the floor 20 of the particular module 17. This results in a narrow slot 21 below the partition 18, which slot, in the exemplary embodiment shown, extends over the entire length (as seen in the transporting direction 13) of the particular module 17. The slot 21 forms an overflow opening between the treatment chamber section 24 and the air guiding chamber 19. From hot air warmed or heated by a heat source, a ventilator 23 in the air guiding chamber 19 produces a hot air flow which passes from above into the treatment chamber 10, namely the treatment chamber section 24, of the particular module 17. As a result, a hot air flow (transverse air flow) which is directed from the top downwards and runs transversely with respect to the transporting direction 13 is produced in the treatment chamber section 24 of the particular module 17.

Figure 3:
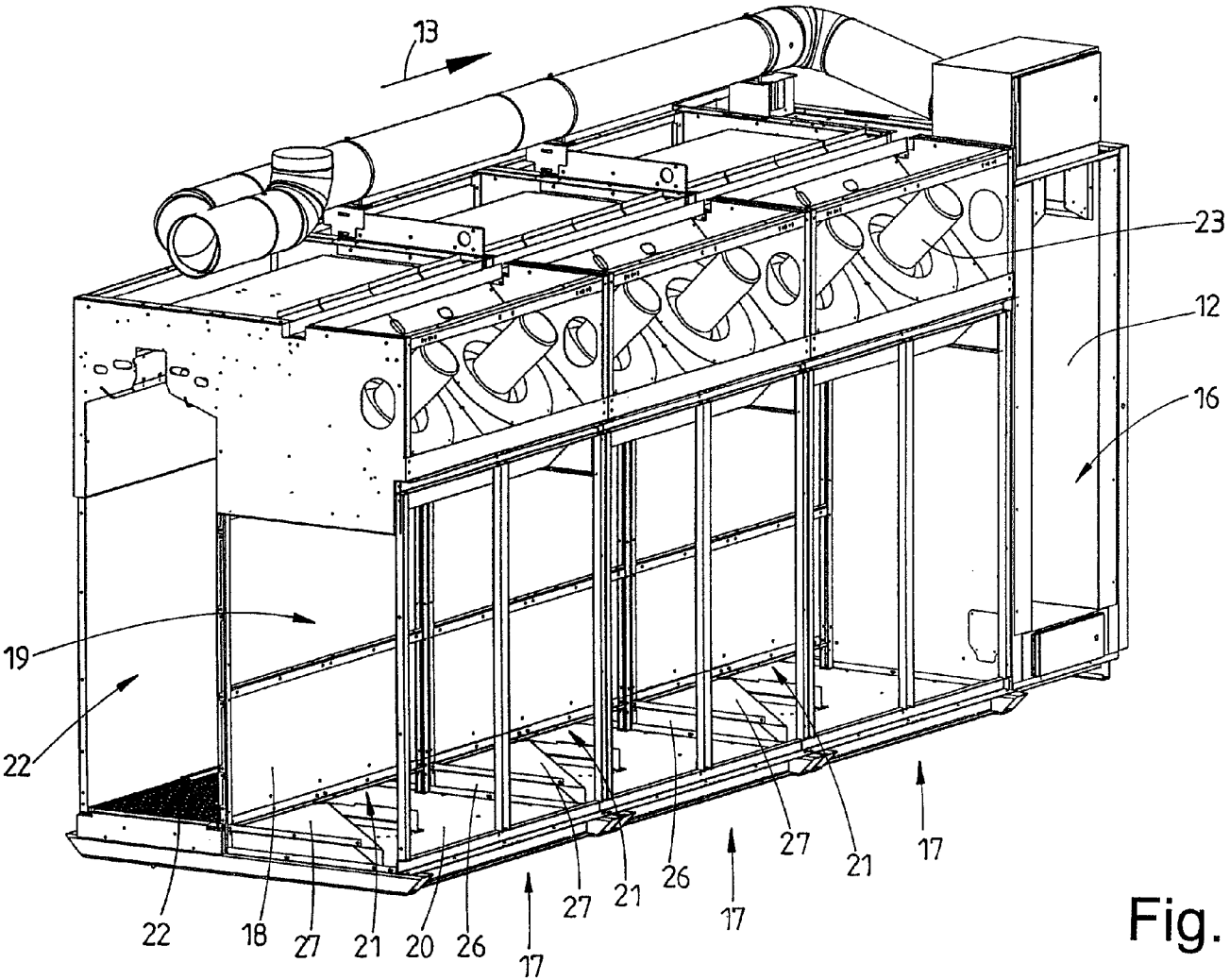
FIG. 3 shows a perspective view of the tunnel finisher of FIG. 2 in cross section.

A respective vertical partition 25 which runs transversely with respect to the transporting direction 13 is situated between the air guiding chambers 19 of adjacent modules 17. For the sake of a better overall view, the partitions 25 are not shown in FIG. 3. Opposite partitions 25 of consecutive modules 17 bound the air guiding chamber 19 of each module 17, as seen in the transporting direction 13. At least some partitions 25 between the modules 17 also end at a small distance above the floor 20 of the tunnel finisher in order to form a slot 26 between consecutive air guiding chambers 19. In the air guiding chamber 19, behind the slot 26 of each module 17, there is an air guiding passage 27 which, from the air guiding chamber 19, adjoins a front part, as seen in the transporting direction 13, in particular a front half, of the slot 21 under the partition 18, which runs longitudinally with respect to the transporting direction 13, between the treatment chamber section 24 and the air guiding chamber 19 of a particular module 17. A sifter-like grating, which is a lint sifter 22 in the exemplary embodiment shown, is arranged at a parallel distance above the floor 20 in the treatment chamber section 24 of each module 17. The lint sifter 22 is at a distance from the floor 20 that corresponds to the height of the slot 21 below the partition 18. Approximately half way along (as seen in the transporting direction 13) each module 17, a vertical partition running transversely with respect to the transporting direction 13 is arranged below the lint sifter 22. Said partition adjoins the air guiding passage 27 at the floor of the air guiding chamber 19, and therefore air, in particular hot air, can be sucked in from the rear half, as seen in the transporting direction 13, of the particular module 17 (which half points towards the subsequent module 17 or to the discharge chamber 12), for example of the second middle module 17 of the exemplary embodiment of FIG. 3, through the partial surface of the lint sifter 22, which is situated at the rear, and the slot 21 into the air guiding chamber 19 of the same (second) module 17. Air, in particular hot air, passes through the air guiding chamber 27 from a subsequent (third) module 17, as seen in the transporting direction 13, into the air guiding chamber 19 of the second module 17. As a result, the air guiding chambers 19 of the modules 17 (with the exception of the last module 17) are fed both with hot air from the treatment chamber section 24 of the particular module 17 and from the treatment chamber section 24 of the subsequent module 17. The result is that the front modules 17, as seen in the transporting direction 13, obtain more warm air than the modules 17 located behind them, and therefore a lower air pressure arises in the rear (last) module 17 than in the modules 17 situated in front of it, that is to say the air pressure increases in a stepwise manner from module 17 to module 17 counter to the transporting direction 13, i.e. to the first module 17. By this means, a counterflow is produced in the treatment chamber 10 in an opposite direction to the transporting direction 13, i.e. in the direction of the admission opening 15 of the tunnel finisher. In this manner, according to the invention, the articles of clothing to be finished are subjected, in particular in the treatment chamber 10, to a transverse air flow and a counter air flow, to be precise in each case to heated air. The vertical partition may also be arranged eccentrically below the lint sifter 22. Air is then sucked out of the treatment chamber section 24 of the particular module 17 into the air guiding chamber 19 through differently sized partial surfaces of the lint sifter 22. Consequently, more or less than half the quantity of air passes from the particular treatment chamber section 24 into the air guiding chamber of the previous module 17.

On the ceiling of the treatment chamber 10 of the tunnel finisher there are air nozzles (not shown here) from which steam and the hot air is conducted from above onto the articles of clothing 14 to be finished. This steam is carried along by the hot air, which, according to the invention, is guided in a transverse flow and also in counterflow, counter to the transporting direction 13 to the start of the treatment chamber 10 and preferably into the admission chamber 11.

Figure 2:
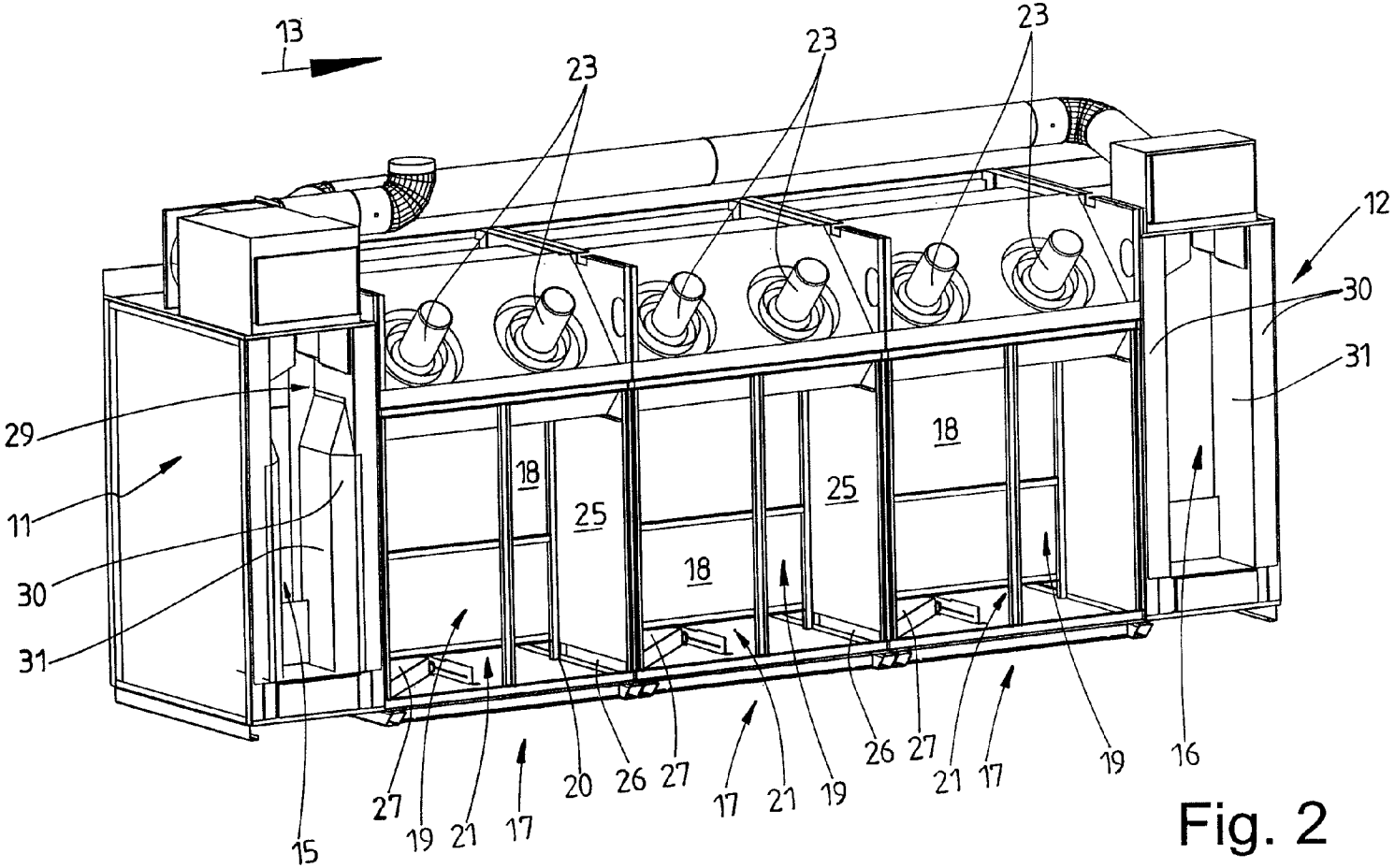
FIG. 2 shows a perspective view of the tunnel finisher without front walls.

According to the invention, the admission chamber 11 and the discharge chamber 12 are provided with a relatively long length (as seen in the direction of passage of the articles of clothing 14). In the exemplary embodiment of FIG. 2, the admission chamber 11 and the discharge chamber 12 both have an identical length, namely extend over the entire width of the tunnel finisher, namely of a module 17. Accordingly, the admission chamber 11 and the discharge chamber 12 are each of a length which corresponds to the width of the air guiding chambers 19 and of the treatment chamber section 24 of the particular module 17. In the exemplary embodiment of FIG. 1, the admission chamber 11 and the discharge chamber 12 are longer than the width of the tunnel finisher. The admission chamber 11 and the discharge chamber 12 protrude over the front side 28 of the tunnel finisher approximately by the magnitude of the width of the treatment chamber. In addition, those regions of the admission chamber 11 and of the discharge chamber 12 which protrude in relation to the front side 28 are angled by 90°, to be precise in such a manner that the admission opening 15 upstream of the admission chamber 11 and the discharge opening 16 downstream of the discharge chamber 12 are directed towards each other and extend for a certain distance in the direction of the center of the tunnel finisher. In this admission chamber 11 and discharge chamber 12, the articles of clothing are deflected twice by 90° during transportation before they enter the treatment chamber 10 and reach the discharge opening 16 from the treatment chamber 10.

By means of the extension according to the invention of the admission chamber 11, the articles of clothing 14 can already be relatively intensively heated in the admission chamber 11, with the energy required for this originating from the hot air passing as a consequence of the counterflow in the treatment chamber 10 from the same into the admission chamber, and from the entrained hot steam. The articles of clothing 14 are then preheated upon entry into the treatment chamber 10 to such an extent that the finishing treatment begins immediately, namely hot steam can be blown onto the articles of clothing 14 from the ceiling of the treatment chamber 10.

The effect achieved by extending the discharge chamber 12 is that the articles of clothing 14 have more time for drying and cooling in the same. It is thereby ensured that portions of the articles of clothing 14, for example seams, a doubled width of material and hems, which are difficult to dry are essentially completely dried when the articles of clothing 14 leave the discharge chamber 12 through the discharge opening 16.

In the case of the tunnel finisher shown, in which the treatment chamber 10 is formed from a plurality of modules 17 arranged one behind another in the transporting direction 13, no heating of the last module 17 before the discharge chamber 12 takes place according to the invention. Accordingly, only air which has not been heated is conducted out of the air guiding chamber 19 of the last module 17 into the treatment chamber section 24. Unheated air is therefore conducted out of the air guiding chamber 19 of the last module 17 into the treatment chamber section 24 of the last module 17.

In the case of the tunnel finisher according to the invention, the heating of air in the last module 17 can be omitted because an intensive finishing treatment takes place in the preceding modules 17, in particular the finishing treatment already begins in the first module 17. Since no more heating of the air takes place in the last module 17, energy can be saved in the tunnel finisher according to the invention and the risk of overheating the articles of clothing 14 is reliably avoided.

Furthermore, it is provided according to the invention to at least partially reduce the width of the admission opening 15 of the admission chamber 11 and/or the discharge opening 16 of the discharge chamber 12. In the case of the tunnel finisher shown here, only the admission opening 15 is reduced in width, to be precise apart from an upper wider region 29. This region 29 is dimensioned in such a manner that it is somewhat larger than the width of the transporting hangers with which the articles of clothing 14 can be transported through the tunnel finisher. Below the wider region 29, the admission opening 15 is constricted, preferably uniformly, by means of box-type attachments 30 arranged on opposite sides of the admission opening 15. The two box-type attachments 30 constrict the admission opening 15 approximately by a third up to half of the width of the upper region 29. In the exemplary embodiment shown, the box-type attachments 30 are of trapezoidal design (as seen from above in cross section) by then becoming narrower towards their top surfaces 31 which point towards the center of the admission opening 15. By means of this design of the box-type attachments 30, during transportation through the admission opening 15 the articles of clothing 14 are compressed and therefore constricted by the regions hanging below the transporting hangers. As a result, the articles of clothing close the admission opening 15 during transportation through it. An undesirable exchange of air through the admission opening 15 is therefore prevented or at least reduced, as a result of which energy losses in the region of the admission opening 15 are eliminated.

The tunnel finisher according to the invention is provided in the region of the admission opening 15 or of the discharge opening 16 with means which produce a pneumatic barrier. In the case of the tunnel finisher shown here, means of this type are assigned both to the admission opening 15 and to the discharge opening 16.

Figure 4:
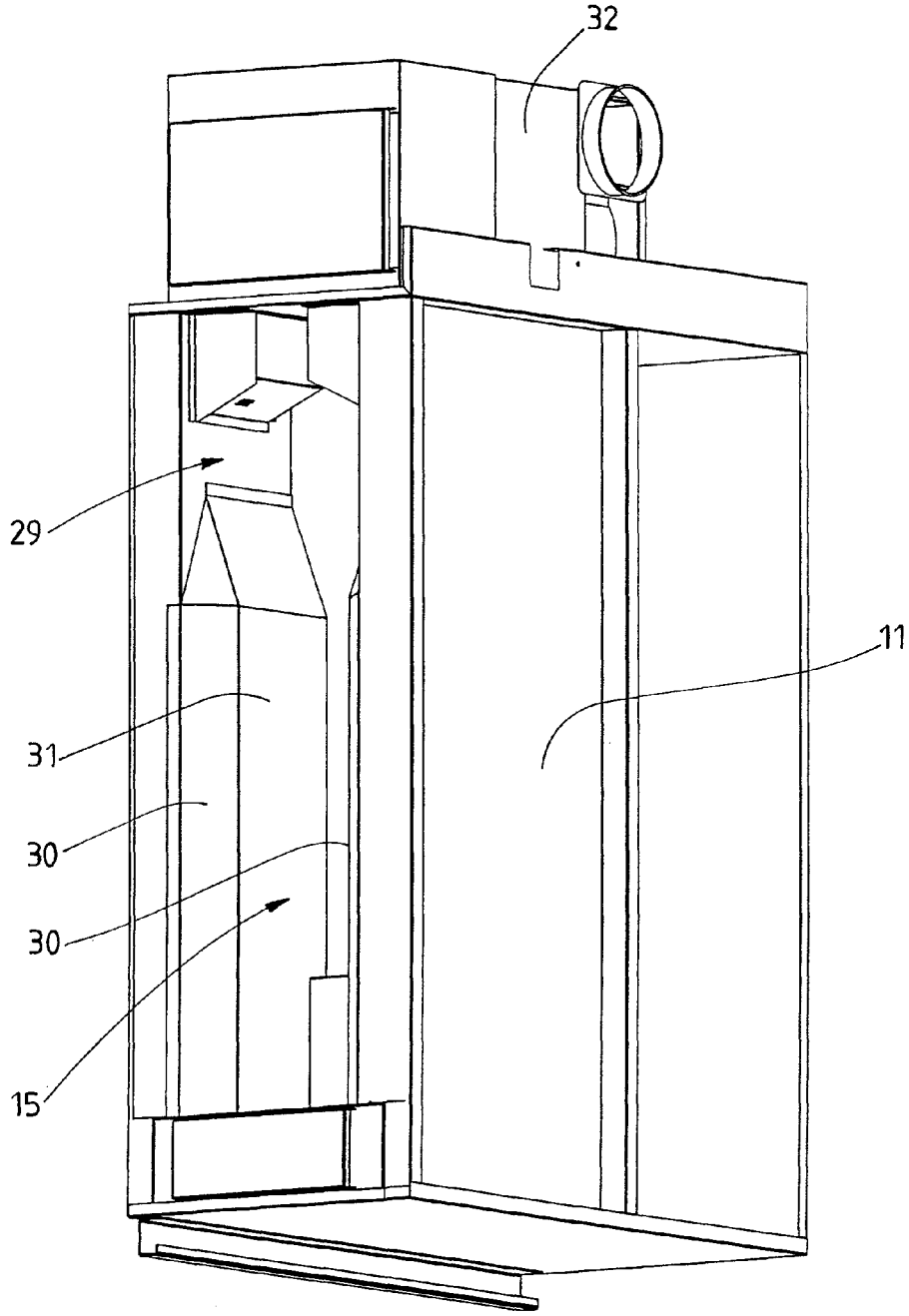
FIG. 4 shows a perspective illustration of an admission chamber of the tunnel finisher with an admission opening.

The pneumatic barrier is produced in the region of the admission opening 15 by blowing nozzles or blowing slots which are arranged in the plane of the admission opening 15 and directly behind it, as a result of which the pneumatic barriers, in particular air curtains, lie in the plane of the admission opening 15. As FIG. 1, above all, shows, the hot air is removed by suction in the narrowed region of the admission opening 15 or behind it, i.e. at the point at which the compressed articles of clothing 14 are already partially closing the admission opening 15. The same can apply analogously to the discharge opening. The suction nozzles serve to suck up or suck off spray steam, in particular spray steam vapor, or hot air in the region of the admission opening 15. As a result, an exiting of hot air or spray steam from the admission chamber 11 is at least reduced and in this respect counteracts an energy loss. The suck-off nozzles or slots are arranged on the rear side of the box-type attachments 30, which also serve to reduce the width of the admission opening 15, and, in the exemplary embodiment shown, are also arranged on the boxes above the wider region 29 (FIG. 4). As a result of the interior of the box-type attachments 30, which are otherwise airtight, being subjected to a negative pressure, hot air or spray steam is sucked into the box-type attachments 30 through the suction nozzles or suction slots. Further suck-off nozzles or suck-off slots can be arranged in the wider region 29 above the box-type attachments 30, as a result of which an exiting of hot air or exiting of spray steam from the admission chamber 11 is avoided, at least for the most part, over the entire admission opening 15.

Cold outside air would be sucked up at the discharge opening 16 because of the counterflow in the treatment chamber 10. In order to avoid this, blowing nozzles or blowing slots are provided which produce an air barrier which is located in the plane of the discharge opening 16 or upstream of it, as seen in the transporting direction 13. Accordingly, all of the blowing nozzles or blowing slots are arranged in the plane or in the vicinity of the plane of the discharge opening 16 and are designed in such a manner that the air emerging from the blowing nozzles or slots lies in the plane of the discharge opening 16 or parallel thereto.

In the lower region of the admission opening 15, the blowing nozzles or blowing slots are arranged in the box-type attachments 30. Further blowing nozzles or blowing slots can be arranged in the wider region 29 above the box-type attachments 30. Supplying the blowing nozzles or blowing slots with compressed air also makes it possible to provide, at the admission opening 15, a pneumatic barrier which prevents or at least reduces the entry of cold ambient air into the admission chamber 11.

In the exemplary embodiment shown here (FIG. 1), it is provided to supply the blowing nozzles and/or blowing slots of the discharge opening 16 with hot air or spray steam removed by suction at the admission opening 15. Accordingly, the air removed by suction at the admission opening 15 is guided via an air line 32 to the discharge opening 16. In order to produce a sufficient air flow and a sufficient air pressure at the blowing nozzles or blowing slots of the discharge opening 16, a ventilator 33 is provided in the air line 32. In the case of the tunnel finisher shown, a secondary line 34 branches off from the air line 32 leading to the discharge opening 16 and can be used to pass excess hot air or hot steam into the open air via a chimney.

By using hot air from the region of the admission opening 15 in order to produce a pneumatic air barrier in the region of the discharge opening 16, an air barrier comprising warm air can be produced at the discharge opening 16, as a result of which hot air or at least warmer air than the ambient air flows out of the blowing nozzles and/or blowing slots of the discharge opening 16. As a result, relatively warm or even hot air passes into the discharge chamber 12 in order to produce the pneumatic barrier at the discharge opening 16 so as to accelerate the drying of the articles of clothing 14 in the discharge chamber 12. The entry of cold ambient air through the discharge opening 16 into the discharge chamber 12 is thus avoided. In addition, a higher temperature level thus remains in the last unheated module 17.

The suction nozzles or slots are arranged around the admission opening 15 in such a manner that they form a type of suck-off frame at the admission opening 15. The blowing nozzles or blowing slots of the discharge opening 16 also form a blowing frame at the discharge opening 16.

The invention is furthermore distinguished in that the residence period of the articles of clothing 14 in the reevaporation region of the tunnel finisher is extended. The extension of the residence period of the articles of clothing 14 in the treatment chamber 10 begins after the front spray steam zone of the treatment chamber 10, in which the articles of clothing 14 are also subjected to steam. In addition or alternatively, the residence period of the articles of clothing 14 in the discharge chamber 12 and/or admission chamber 11 or in at least part of the same may also be extended. As a result, the articles of clothing 14 obtain more time for drying and/or preheating because the residence period in the particular zone of the tunnel finisher is increased.

The increasing of the residence period of the articles of clothing 14 in, in particular, the reevaporation zone takes place by means of a reduction in the distance between consecutive articles of clothing 14 and/or a serpentine-like course of that region of the conveying route, since the residence period or the articles of clothing 14 in the tunnel finisher or the particular chamber is to be extended, i.e. preferably in at least part of the reevaporation zone, preferably the entire reevaporation zone. The serpentine-like course of the conveying route is indicated schematically in FIG. 1. Although, as a result of the transporting system, which is guided in a circuit, for the transporting hangers with the articles of clothing 14 hanging thereon, the conveying speed of the same through the tunnel finisher is the same throughout, the residence period of the articles of clothing 14 in this region is increased because of the extended conveying route. In addition, the serpentine-like course of the conveying route also causes the articles of clothing 14 to be moved together, as a result of which a greater number of articles of clothing can be accommodated in the reevaporation zone and, accordingly, the articles of clothing 14 can remain in the reevaporation zone for a longer period of time.

Figure 5:
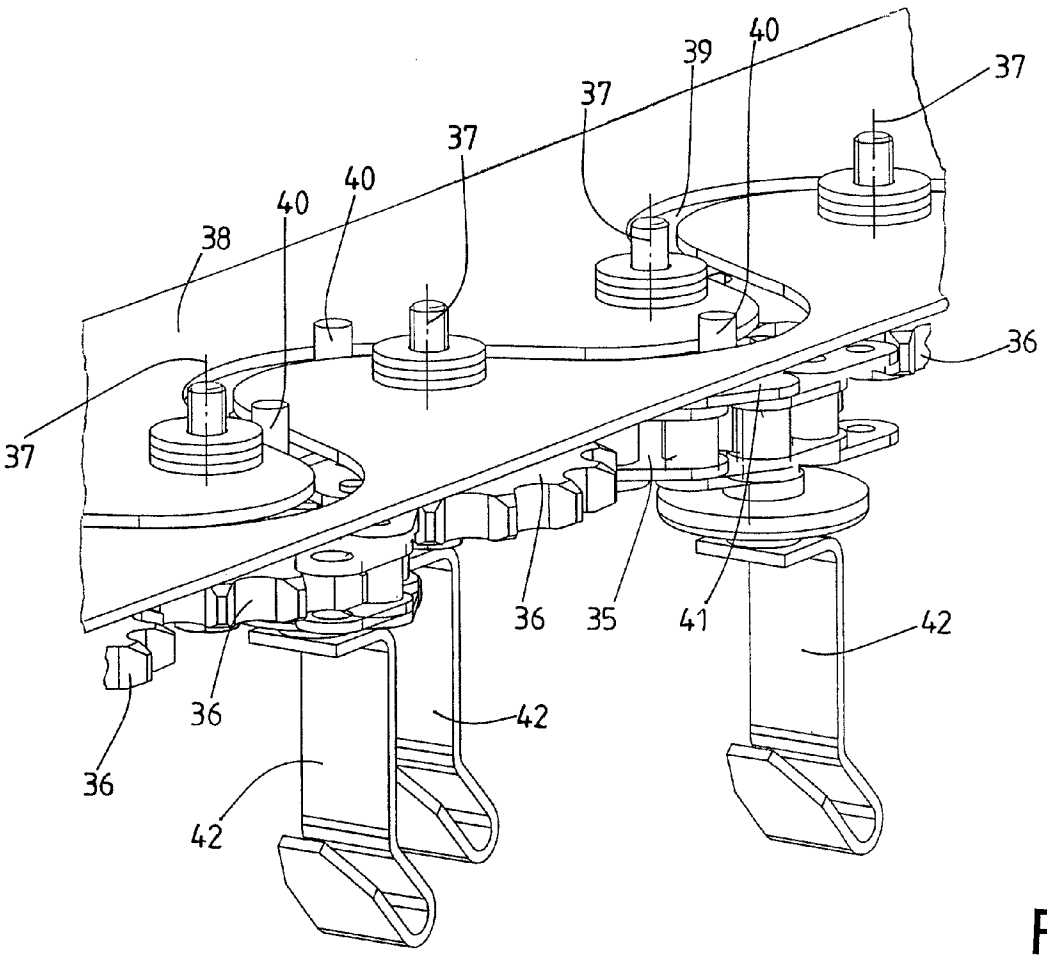
FIG. 5 shows the design of the conveyor of the tunnel finisher in order to extend the conveying route.

FIG. 5 shows a possibility for extending the residence period of the articles of clothing 14 in selected regions of the tunnel finisher according to the invention. According thereto, a conveying chain 35 or a comparable conveying section of an encircling conveying system, for example a belt, is deflected by consecutive gearwheels 36 at the point at which the residence period of the articles of clothing 14 in the tunnel finisher is to be increased. The gearwheels 36 can be freely rotatable. It is also conceivable to drive at least one of the gearwheels 36. The vertical axes of rotation 37 of the gearwheels 36 preferably all lie on a common line which runs in the transporting direction 13. The conveying chain 35 is guided in an alternating manner around opposite sides of the gearwheels 36, as a result of which the serpentine-like course of the conveying chain 35 comes about.

Arranged above the gearwheels is a fixed, elongate slotted link 38 which has a guide slot 39 corresponding to the serpentine-like or S-shaped course of the conveying chain 35. Pegs 40 which protrude in relation to the conveying chain 35 project into the guide slot 39. Said pegs 40 are assigned to those chain links 41 of the conveying chain 35 on each of which there is a supporting hook 42 for a transporting hanger (not shown). The peg 40 is connected fixedly by means of a tab (not shown) at a parallel distance to a supporting hook 42 which can be rotated freely about a vertical axis of rotation in relation to the chain link 41. This results in a rotation of the supporting hook 42 about the vertical axis of rotation. As a result, the supporting hooks 42 are always rotated during their serpentine-like movement in the transporting direction 13 in such a manner that they are always oriented identically, as a result of which the transporting hangers with the articles of clothing 14 hanging on them are always oriented transversely with respect to the transporting direction 13 even in the S-shaped or serpentine-like region of the conveying route. The transporting hangers with the articles of clothing 14 hanging thereon therefore always remain oriented transversely with respect to the transporting direction 13 even when the conveying chain 35 is guided in a serpentine-like manner or is deflected in order to extend the residence period of the articles of clothing 14 in the tunnel finisher.

The invention is suitable for tunnel finishers for treating all types of articles of clothing, to be precise in launderettes or else in production factories. In the latter, the tunnel finisher may also be used for finishing parts of completed articles of clothing. However, the tunnel finishers according to the invention may also be used for finishing other textiles, for example of vehicle seats.

What is claimed is:

1. A method for smoothing articles of clothing (14) in a tunnel finisher, comprising the steps of:

(a) transporting the articles of clothing (14) in a transporting direction (13) through an admission chamber (11), a treatment chamber (10) and a discharge chamber (12) of the tunnel finisher;

(b) in the treatment chamber (10), directing a transverse air flow transversely with respect to the transporting direction (13) of the articles of clothing (14) through the treatment chamber (10), and subjecting the articles of clothing (14) to the transverse air flow; and (c) in addition to the transverse air flow, subjecting the articles of clothing (14) to a counter air flow directed counter to the transporting direction (13), wherein the treatment chamber (10) is formed from modules (17) following one another in the transporting direction (13), and wherein the counter air flow is produced by introducing some of the air produced in at least one of the modules (17) into the module (17) preceding the at least one of the modules (17) resulting in a spiral flow of air that extends through the treatment chamber (10) counter to the transportation direction (13).

2. The method as claimed in claim 1, wherein the transverse air flow and the counter air flow are hot air flows.

3. The method as claimed in claim 1, further comprising, by means of an extension of the admission chamber (11) and/or of the discharge chamber (12), increasing the residence time of the articles of clothing (14) in the admission chamber (11) and/or the discharge chamber (12) over the residence time of the articles of clothing (14) in the admission chamber (11) and/or of the discharge chamber (12) without the extension.

4. The method as claimed in claim 3, wherein the extension of the admission chamber (11) and/or the discharge chamber (12) corresponds at least to the length and/or width of the module (17) for forming part of the treatment chamber (10).

5. The method as claimed in claim 1, wherein the articles of clothing (14) are transported in a transversely directed manner through the admission opening (15) and/or the discharge opening (16), the admission opening (15) and/or the discharge opening (16) being narrower at least in some regions than the articles of clothing (14).

6. The method as claimed in claim 5, further comprising pneumatically producing an air curtain in the region of the admission opening (15) and/or of the discharge opening (16).

7. The method as claimed in claim 5, further comprising removing air by suction in the region of the admission opening (15) and/or air is blown out in the region of the discharge opening (16).

8. The method as claimed in claim 5, further comprising at least reducing exit of hot air out of the admission opening (15) by removing the hot air by suction at the admission opening (15).

9. The method as claimed in claim 8, wherein the hot air that is removed by suction at the admission opening (15) is blown out of the tunnel finisher in the region of the discharge opening (16) in order to produce an air barrier made of the hot air that is removed by suction at the admission opening (15), which air barrier, at least for the most part, avoids ambient air being sucked into the tunnel finisher at the discharge opening (16).

10. The method as claimed in claim 5, further comprising blowing air out in the region of the discharge opening (16).

11. The method as claimed in claim 5, further comprising removing air by suction in the region of the admission opening (15) and blowing air out in the region of the discharge opening (16).

12. The method as claimed in claim 1, further comprising, at an exit end of the treatment chamber (10), at least partly subjecting the articles of clothing (14) to unheated air.

13. The method as claimed in claim 12, wherein the air in a last module (17) of the treatment chamber (10) is not directly heated.

14. The method as claimed in claim 13, further comprising heating the air in the last module (17) by heat absorbed by the articles of clothing (14) when subjected to hot air in at least one preceding module (17) of the treatment chamber (10).

15. The method as claimed in claim 13, further comprising raising the temperature of air in the last module (17) by blowing in hot air from the discharge chamber (12).

16. The method as claimed in claim 1, further comprising reducing a distance between consecutive articles of clothing (14) during transportation of the articles of clothing (14) through selected regions of the tunnel finisher.

17. The method as claimed in claim 16, wherein the reduction in the distance between the articles of clothing (14) takes place at least in the region of the admission chamber (11) and of the discharge chamber (12).

18. The method as claimed in claim 1, wherein, for the treatment of the articles of clothing (14) to last for a longer time, the treatment chamber (10) comprises a serpentine-like course along the transporting direction (13), whereby a transporting distance of the articles of clothing (14) is extended by the serpentine-like course in the treatment chamber (10).

19. A method for smoothing articles of clothing (14) in a tunnel finisher, comprising the steps of:

(a) transporting the articles of clothing (14) in a transporting direction (13) through an admission chamber (11), a treatment chamber (10) and a discharge chamber (12) of the tunnel finisher;

(b) in the treatment chamber (10), directing a transverse air flow transversely with respect to the transporting direction (13) of the articles of clothing (14) through the treatment chamber (10);

(c) subjecting the articles of clothing (14) to the transverse air flow in the treatment chamber (10); and (d) subjecting the articles of clothing (14) to a counter air flow directed counter to the transporting direction (13) in the treatment chamber (10), the counter air flow being produced by a spiral flow of air that extends through the treatment chamber (10) counter to the transportation direction (13).

20. The method as claimed in claim 19, wherein the treatment chamber (10) is formed from modules (17) following one another in the transporting direction (13).

21. The method as claimed in claim 20, wherein the counter air flow is produced by introducing some of the air produced in at least one of the modules (17) into the module (17) preceding the at least one of the modules (17).

22. The method as claimed in claim 19, wherein the transverse air flow and the counter air flow are hot air flows.

23. The method as claimed in claim 19, wherein, by means of an extension of the admission chamber (11) and/or of the discharge chamber (12), the residence time of the articles of clothing (14) in the admission chamber (11) and/or the discharge chamber (12) is increased over the residence time of the articles of clothing (14) in the admission chamber (11) and/or of the discharge chamber (12) without the extension.

24. The method as claimed in claim 19, wherein the articles of clothing (14) are transported in a transversely directed manner through the admission opening (15) and/or the discharge opening (16), the admission opening (15) and/or the discharge opening (16) being narrower at least in some regions than the articles of clothing (14).

25. The method as claimed in claim 19, wherein, at an exit end of the treatment chamber (10), the articles of clothing (14) are at least partly subjected to unheated air.

26. The method as claimed in claim 19, wherein, for the treatment of the articles of clothing (14) to last for a longer time, a distance between consecutive articles of clothing (14) is reduced.

27. The method as claimed in claim 19, wherein, for the treatment of the articles of clothing (14) to last for a longer time, the treatment chamber (10) comprises a serpentine-like course along the transporting direction (13), whereby a transporting distance of the articles of clothing (14) is extended by a serpentine-like course of the conveying route in the treatment chamber (10).

28. A method for smoothing articles of clothing (14) in a tunnel finisher, comprising the steps of:

(a) transporting the articles of clothing (14) in a transporting direction (13) through an admission chamber (11), a treatment chamber (10) and a discharge chamber (12) of the tunnel finisher;

(b) in the treatment chamber (10), directing a transverse air flow transversely with respect to the transporting direction (13) of the articles of clothing (14) through the treatment chamber (10), and subjecting the articles of clothing (14) to the transverse air flow; and (c) in addition to the transverse air flow, subjecting the articles of clothing (14) to a counter air flow directed counter to the transporting direction (13), wherein the treatment chamber (10) is formed from modules (17) following one another in the transporting direction (13) and comprises a serpentine-like course along the transporting direction (13), whereby a transporting distance of the articles of clothing (14) is extended by the serpentine-like course in the treatment chamber (10), wherein the counter air flow is produced by introducing some of the air produced in at least one of the modules (17) into the module (17) preceding the at least one of the modules (17), and wherein the introducing of some of the air produced in at least one of the modules (17) into the module (17) preceding the at least one of the modules (17) results in a spiral flow of air that extends through the treatment chamber (10) counter to the transportation direction (13).

29. A method for smoothing articles of clothing (14) in a tunnel finisher, comprising the steps of:

(a) transporting the articles of clothing (14) in a transporting direction (13) through an admission chamber (11), a treatment chamber (10), and a discharge chamber (12) of the tunnel finisher, wherein the articles of clothing are transported in a serpentine-like course in the transportation direction (13) through the treatment chamber (10);

(b) in the treatment chamber (10), directing a transverse air flow transversely with respect to the transporting direction (13) of the articles of clothing (14) through the treatment chamber (10);

(c) subjecting the articles of clothing (14) to the transverse air flow in the treatment chamber (10); and (d) subjecting the articles of clothing (14) to a counter air flow directed counter to the transporting direction (13) in the treatment chamber (10), the counter air flow being produced by a spiral flow of air that extends through the treatment chamber (10) counter to the transportation direction (13).

* * * * *